US009248416B2

(12) United States Patent
Striebinger

(10) Patent No.: US 9,248,416 B2
(45) Date of Patent: Feb. 2, 2016

(54) APPARATUS FOR THE PRESSURIZATION AND EVACUATION OF A CONTAINER

(76) Inventor: Marc C. Striebinger, Las Vegas, NV (US)

( * ) Notice: Subject to any disclaimer, the term of this patent is extended or adjusted under 35 U.S.C. 154(b) by 507 days.

(21) Appl. No.: 13/615,918

(22) Filed: Sep. 14, 2012

(65) Prior Publication Data

US 2014/0075888 A1 Mar. 20, 2014

(51) Int. Cl.

*B65B 31/00* (2006.01)
*B65B 31/04* (2006.01)
*B01F 3/04* (2006.01)

(52) U.S. Cl.

CPC ..... *B01F 3/04801* (2013.01); *B65B 31/00* (2013.01); *B65B 31/046* (2013.01); *B65B 31/047* (2013.01)

(58) Field of Classification Search

CPC .... B65B 31/00; B65B 31/046; B65B 31/047; B65B 31/08
USPC ..... 53/432; 141/4, 17
See application file for complete search history.

(56) References Cited

U.S. PATENT DOCUMENTS 2,705,578 A 2/1952 Bums
3,498,313 A 3/1970 Belich
3,752,452 A * 8/1973 Iannelli ..... B01F 3/04808 261/124
3,868,978 A 3/1975 Knopf
4,395,940 A 8/1983 Child
4,552,153 A 11/1985 Newman
4,676,283 A * 6/1987 Caldwell ..... B01F 3/04794 141/29
4,702,396 A 10/1987 Gwiazda
4,763,803 A 8/1988 Schneider
4,838,324 A 6/1989 Boyd
4,867,209 A 9/1989 Santoiemmo
4,934,543 A 6/1990 Schmidt
4,969,493 A 11/1990 Lee
5,215,129 A * 6/1993 Berresford ..... B65B 31/047 141/65
5,316,055 A * 5/1994 Brimmer ..... B60S 5/04 141/17
5,329,975 A * 7/1994 Heitel ..... 141/19
5,396,934 A 3/1995 Moench
5,452,819 A 9/1995 Vance
5,458,165 A 10/1995 Liebmann, Jr.
5,531,254 A 7/1996 Rosenbach
5,549,037 A 8/1996 Stumphauzer et al.
5,564,478 A 10/1996 Weinheimer et al.
5,586,588 A 12/1996 Knox
5,590,696 A 1/1997 Phillips
5,595,104 A 1/1997 Delaplaine
5,635,232 A 6/1997 Wallace
5,836,364 A 11/1998 Burton
6,036,054 A 3/2000 Grill
6,189,578 B1 * 2/2001 Clusserath ..... B67C 3/10 141/293

(Continued)

*Primary Examiner* — Andrew M Tecco
*Assistant Examiner* — Chelsea Stinson
(74) *Attorney, Agent, or Firm* — Knechtel, Demeur & Samlan

(57) ABSTRACT

A device for the pressurization and evacuation of a gas in a bottle, in order to approximate the unopened (ambient) conditions of a previous gaseous state in said bottle. Two units comprise this system, namely a charging unit and a sealing-valve unit. When the charging unit is coupled to the sealing-valve unit three functions can be performed. The first is a priming function where the bottle is partially evacuated of its ambient air and replaced with a gas from a cartridge. The second is a charging function where the primed bottle is pressurized with the same gas type or mixture from the pressurized gas cartridge. The third is an evacuating function where the charged bottle can be bled of gas to achieve the approximate ambient condition of an unopened bottle. This function is used when a bottle is overcharged and a lower pressure is desired.

17 Claims, 8 Drawing Sheets

(56) References Cited

U.S. PATENT DOCUMENTS

| | | | | |
|---|---|---|---|---|
| 6,276,565 | B1 | 8/2001 | Parsons | |
| 6,325,235 | B1 | 12/2001 | Telvin | |
| 6,386,403 | B2 | 5/2002 | Parsons | |
| 6,530,401 | B1 | 3/2003 | Angehrn | |
| 6,691,746 | B2 | 2/2004 | Brennan | |
| 6,698,466 | B1 | 3/2004 | Cowan | |
| 6,799,697 | B1 | 10/2004 | Keller | |
| 6,878,411 | B2 | 4/2005 | Manz | |
| 6,898,979 | B2 | 5/2005 | Cowan | |
| 7,004,206 | B2 * | 2/2006 | Viken | F01M 11/0458 141/1 |
| 7,104,033 | B2 | 9/2006 | Krulitsch | |
| 7,341,056 | B1 | 3/2008 | Tucker | |
| 7,469,729 | B2 | 12/2008 | Aukett | |
| 7,533,701 | B2 | 5/2009 | Gadzic | |
| 7,682,505 | B2 | 3/2010 | Vidalinc | |
| 7,726,356 | B2 | 6/2010 | van der Lande | |
| 7,743,796 | B1 | 6/2010 | Schooley | |
| 7,882,861 | B2 | 2/2011 | Swanson | |
| 7,984,845 | B2 | 7/2011 | Kelly | |
| 8,038,039 | B2 | 10/2011 | Kelly | |
| 8,052,012 | B2 | 11/2011 | Kelly | |
| 8,070,023 | B2 | 12/2011 | Vitantonio | |
| 2005/0074342 | A1 * | 4/2005 | Lemme | B65B 31/047 417/415 |
| 2008/0217361 | A1 * | 9/2008 | Vitantonio et al. | 222/399 |

* cited by examiner 42
40
24
28
30
44
32
46
34
50
36
26
22
48
26

196
42
194
40
192
24
56
58
54
28
68
74
60
64
70
66
72
62
44
24
100
94
96
98
102
46
24
124
118
120
122
126
128
130
132
134
146
148
150
50
152
156
154
76
78
80
84
86
82
88
90
92
110
114
116
112
104
106
108
136
138
140
142
144
158
160
164
162
168
166
172
170
174
22
176
178
48
180
182
188
190
186
184
30
32
34
36
26

196
42
194
40
192
24
56
58
54
28
68
74
60
64
70
66
72
62
44
76
78
80
84
86
82
88
90
92
110
114
116
104
112
106
108
100
94
96
98
102
46
124
118
120
122
126
128
130
132
134
136
138
140
142
144
158
160
164
162
166
168
170
172
174
22
146
148
150
50
152
156
154
176
178
48
180
182
188
190
186
184
30
32
34
36
26

196
42
194
40
192
24
56
58
54
28
68
74
60
64
70
66
72
62
44
76
78
24
100
94
96
98
102
80
84
86
82
88
90
92
110
114
116
112
104
106
108
46
24
124
118
120
122
126
128
130
132
134
136
138
140
142
144
158
160
164
162
166
168
170
172
174
22
146
148
150
50
152
156
154
176
178
48
180
182
188
190
186
184
30
32
34
36
26

196
42
194
40
192
24
56
58
54
28
68
74
60
64
70
66
72
62
76
78
80
44
24
100
94
96
98
102
84
86
82
88
90
92
110
116
114
104
112
106
108
46
24
124
118
120
122
126
128
130
132
134
136
138
140
142
144
158
160
164
162
166
168
170
172
174
22
146
148
150
50
152
156
154
176
178
48
180
182
188
190
186
184
30
32
34
36
26

APPARATUS FOR THE PRESSURIZATION AND EVACUATION OF A CONTAINER

BACKGROUND

1. Field of the Invention

This application relates to the process of pressurizing and evacuating the gas contents of a container and, more particularly, to liquid filled containers.

2. Prior Art

Devices for carbonating beverages in the home have been known for some time. They provide the consumer with an inexpensive means of carbonating normally flat beverages, such as water, juices, etc., to make home-made soda.

Commonly, home carbonators employ a pressurized carbon dioxide ($CO_2$) cartridge with a seal at one end that is punctured to release a gas into a container or bottle in order to carbonate the beverage within. The $CO_2$ within the cartridge is stored at pressures up to approximately 850 psi, and thus the bottle for storing the liquid to be carbonated must be a fairly heavy, thick-walled apparatus. Such systems were and are commonly used to make seltzer water. However, such heavy pressure bottles are expensive and relatively awkward to handle.

For example, U.S. Pat. No. 4,395,940 to Child, et al. discloses an appliance for making an aerated beverage utilizing a source of carbon dioxide and a pressure regulating valve to limit the pressure within the bottle to a predetermined pressure limit, at which point the source $CO_2$ gas is vented with a whistling sound. This appliance has several drawbacks, not the least of which is the wasteful venting of the source gas upon reaching the predetermined pressure. Additionally, the device is housed in a relatively cumbersome package, which precludes easy portability.

In U.S. Pat. No. 4,867,209 issued to Santoiemmo, a portable carbonating device is shown having a pressurizer with an internal regulator for attaching to the top of a liquid-filled bottle to dispense $CO_2$ therein. The $CO_2$ is supplied from a disposable cartridge, which is pierced by a needle to deliver gas through the regulator valve and into the bottle. The regulator valve is mounted within a housing which has internal threads for mating with the external threads of the bottle and also a series of external threads on the upper end for mating with a cartridge-enclosing cap. In an alternative embodiment, the device utilizes a tire needle valve for retaining the $CO_2$ within the cartridge between uses. However, after introducing $CO_2$ to a bottle containing a liquid, it is intended that the entire device remain on the bottle for the pressure above the liquid to be maintained until the liquid has absorbed the $CO_2$. The device cannot be removed, for example, to pressurize a different bottle since that would release the pressure above the liquid, thus defeating the purpose of the device.

In addition to a device which carbonates otherwise flat beverages, a need exists for a simple device to re-pressurize carbonated beverages after they have been opened by the consumer. Currently, carbonated beverages are sold in a variety of containers, ranging from 10-ounce to bulk-size one-, two- and three-liter thin walled plastic bottles. For the consumer, the most cost-efficient size is the large economy bottle. However, unless the contents are consumed quickly, the quality of the carbonation is greatly reduced, as the $CO_2$ gas above the liquid escapes every time the bottle cap is opened. The $CO_2$ within the liquid then bubbles out due to the reduced $CO_2$ vapor pressure above the surface of the liquid, causing the remaining beverage to go flat. Commonly, a portion of the remaining flat contents is thrown away. It would be desirable to be able to recharge these economy-size soda bottles with $CO_2$ in order to maintain the carbonation of the beverage. A carbonation apparatus in this case would need to limit the pressure level within the plastic bottle to pressures on the order of 70 psi in order to ensure the plastic does not rupture.

A relatively recent device tried to tackle these problems. U.S. Pat. No. 5,329,975 issued to Heitel, disclosed an apparatus comprised of 2 components. A $CO_2$ bicycle tire inflator and a bicycle tire Schrader valve hermetically sealed to a 2-liter bottle cap. This device addressed the heavy and awkward problem, the wasteful gas problem (to a degree), and the device removal problem. The device also used a regulated trigger to limit the pressure level within the plastic bottle to 70 psi. Not withstanding these advances, many flaws still exist with the device and its stated purpose.

The stated purpose of said device was "a simple device to re-pressurize carbonated beverages after they have been opened by the consumer". However, this may not be achieved, simply, by re-injecting the bottle with $CO_2$. When carbonated soda is made, commercially, the pre-carbonated beverage is fed into a large device that brings the pre-carbonated beverage to a specific temperature and pressure. At this temperature and pressure, pure $CO_2$, surrounding the beverage, dissolves naturally into the beverage. The carbonated beverage is then injected into waiting bottles at ambient temperature and pressure, and is then capped. Incidentally, a small amount of ambient air creeps into the mostly $CO_2$ gas pocket above the beverage before it is capped. Thus, the ambient conditions of an unopened bottle of soda contain mostly $CO_2$ and some ambient $N_2$ and $O_2$ (disregarding trace gasses).

When the bottle of soda is opened and consumed (½ of the bottle consumed for illustration purposes) a lot of things happen. The $CO_2$, in solution, begins to come out of solution under a different temperature and pressure. When the bottle is capped, a large amount of ambient air is locked in the bottle. Once capped, the remaining $CO_2$, in solution, keeps releasing from solution until it creates an equilibrium with the new ambient gas. The remaining $CO_2$, both released from solution and remaining in solution adjusts to the new temperature and pressure of the bottle. Also, the new gas and liquid within the capped bottle are not static. Large amounts of $N_2$ and $O_2$, in the new gas, continuously mix with the soda. Dissolved $N_2$ seems to have a minimal effect on the carbonation and taste of a soda (shown through experimentation). However, dissolved $O_2$ tends to make the beverage flat (shown through experimentation)—likely through dissolved $O_2$ displacement of dissolved $CO_2$ or a breakdown of the carbonic acid in solution.

At first blush, Heitel's apparatus seems to work. However, Heitel's apparatus contains no feature to evacuate the ambient gas in the opened bottle before it is pressurized with $CO_2$. In Heitel's apparatus, ambient air is trapped and pressurized along with the $CO_2$ allowing the pressurized ambient air to degrade the taste and consistency (or "fizz") of the beverage. A priming function (combination of both pressurization and evacuation functions) is necessary to achieve the correct gas type in the bottle.

Along with the inability of Heitel's apparatus to evacuate the ambient gas from the bottle, it is also unable to discharge an over-pressurization of the bottle in a controlled manner. Pressure exceeding the original bottles unopened condition tends to over saturate the beverage with $CO_2$. Over-saturation leads to larger bubble and, to use the vernacular, a mouth full of foam. It is paramount, that the original pressure level of the unopened bottle is duplicated in order to approximate the gas conditions of an unopened bottle.

A more subtle problem exists with Heitel's pressure regulating system in that it is not adjustable. Heitel's pressure regulating system can be factory set to automatically charge just under the safety threshold of 70 psi, a carbonating pressure of about 60 psi, or an equilibrium pressure of about 55 psi. However, it cannot adjust between these levels in the field. This is due to the type and tension of the spring inserted in the button. The automatic pressure level can only be adjusted through spring replacement. Spring replacement would probably have to be done at the factory. Furthermore, automatic pressure setting adjustments for altitude, ambient air pressure, ambient temperature and differing unopened bottle pressures (by brand and bottling company) cannot be adjusted for in the field.

Another problem with Heitel's apparatus is that the patent suggests injection of pure CO2. Stated previously, the gas and the soda are not in a static state after the cap is put on. The gas and the soda continue to mix with each other, unseen. When a half empty bottle is injected with pure CO2, a huge amount of pressurized CO2 is introduced (not present in the small space above the soda in an unopened bottle). This CO2 starts to mix with the soda at the wrong pressure and temperature. What you get is over-saturation of CO2 (similar to an overpressure) and the drink becomes super fizzy when it hits the tongue. Again, you get a mouth full of foam. Thus, pure CO2 injection is probably not the answer to preserving the "fizz" in a previously opened bottle of soda. A mixture of gasses such as N2 and CO2 will work better to maintain the "fizz" at a level similar to an unopened bottle (shown through experimentation).

Finally, Heitel's apparatus does not have a gage to monitor the pressure of the gas in the bottle. Heitel does make reference to a gage but it is inoperable in his embodiment. A gage is also paramount. The goal is to achieve a gas pressure, as close to the ambient gas pressure, of an unopened bottle. A gage is necessary to achieve the correct pressure. A pressurization function and an evacuation function are necessary to achieve the correct pressure. Additionally and previously stated, a priming function (combination of both pressurization and evacuation functions) is also necessary to achieve the correct gas type in the bottle.

In a related field, wine also requires a device for the pressurization and evacuation of a gas in a wine bottle in order to approximate the unopened ambient conditions of a previous gas in said wine bottle. Devices similar to Heitel's invention are also in use in the wine industry. A device that is able to evacuate the wine bottle of ambient air, and replace it with a gas, such as Argon, would be beneficial. Also, a device, able to leave the near pure argon in the wine bottle at atmospheric pressure, would be beneficial. Such a device, would release overpressure, through its evacuation function. A fine wine, under pressure, is frowned upon in the wine community. A need may exist here.

U.S. Pat. No. 6,530,401 is a device, contemplated, for the low pressure, priming of wine or Champaign bottles using nitrogen. It uses an electronic charging head coupled to a stopper with a bottle securing device. The charging head is meant to be mounted to a bar or large heavy object for proper charging. The special stopper and the bottle securing device, necessarily, sit high above the bottle making it difficult to set the bottle vertically in a commercial refrigerator without hitting the shelf above. The device uses a special elastic disk that is circular and inefficient. When the stopper is removed from the charging head, the bottle loses at least 0.3-0.6 bar of pressure during the uncoupling. This is unacceptable for high pressure, precision priming, charging, and evacuating. A device is needed to achieve a gas pressure as close as possible to the ambient gas pressure of an unopened bottle. A device is needed that will obtain variances of 0.01-0.02 bar when a charging head is removed from a sealing device. Also, the special elastic disk, by design, is prone to "blow out" at higher pressures. The device illustrated in this patent is relatively complicated, heavy and inefficient and is therefore uneconomical for household use.

In summary, a need exists for an improved hand-held device for the pressurization and evacuation of a gas in a bottle in order to approximate the unopened ambient conditions of a previous gaseous state in said bottle.

SUMMARY

In accordance with one embodiment, a hand-held device for the pressurization and evacuation of a gas in a bottle in order to approximate the unopened ambient conditions of a previous gaseous state in said bottle and to be able to accurately control and repeat the pressurization of the bottle.

DRAWINGS

In the drawings, z-axis views have the same number but different alphabetic suffixes.

Figure 4B:
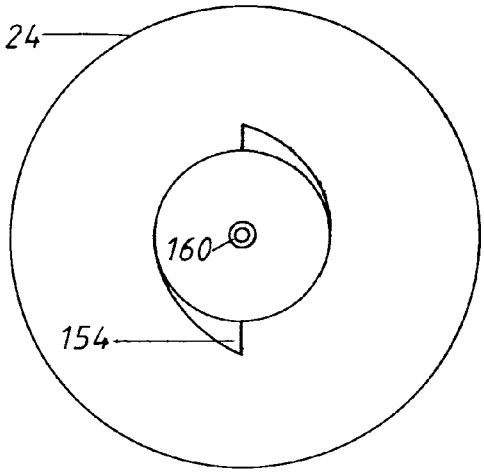
Figure 4A:
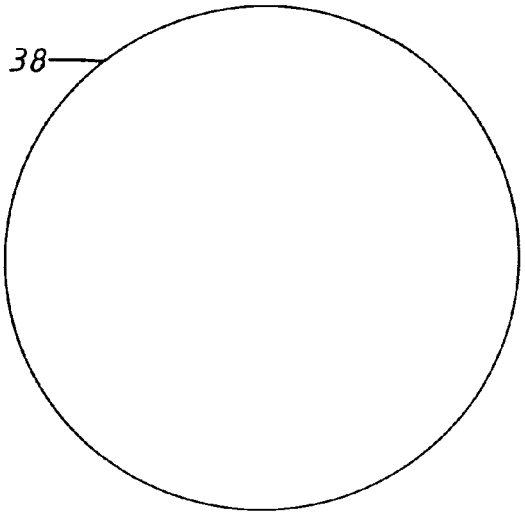

FIG. 4*a* is a top view of the charging unit.

FIG. 4*b* is a bottom view of the charging unit.

Figure 4C:
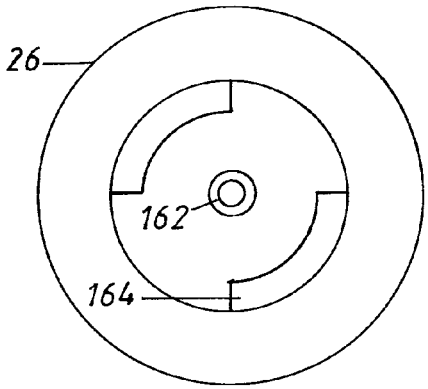

FIG. 4*c* is a top view of the sealing-valve unit.

Figure 4D:
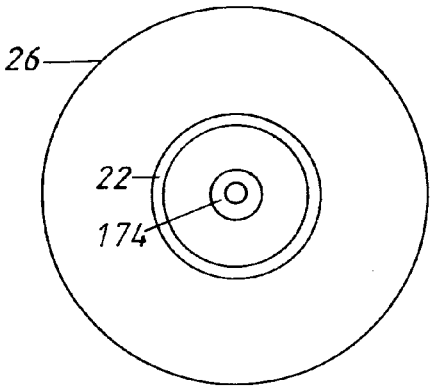

FIG. 4*d* is a bottom view of the sealing-valve unit.

Figure 5:
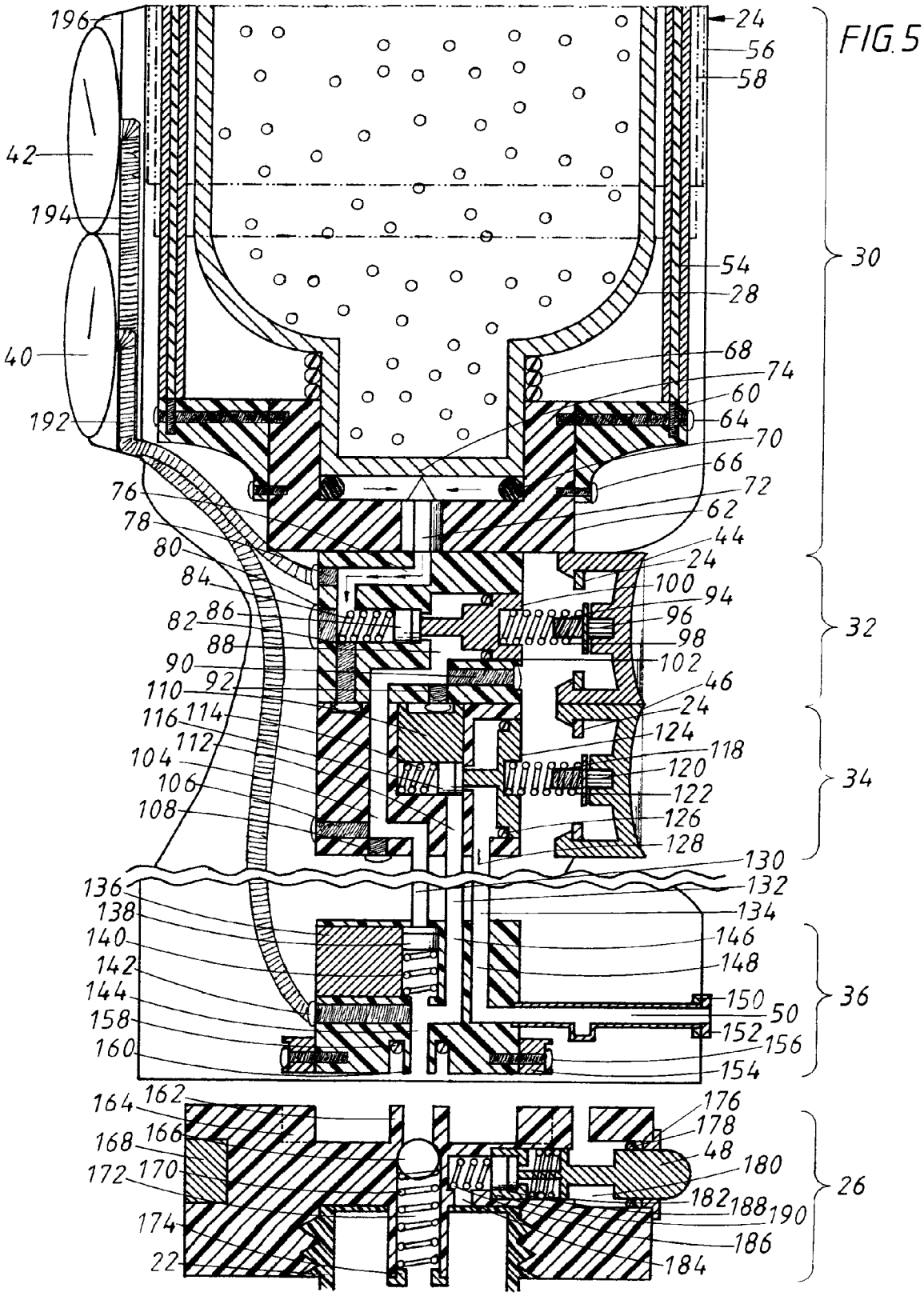

FIG. 5 is a front cross section view with portions removed showing the flow of gas from the gas cartridge when the gas cartridge is initially installed and pierced.

Figure 6:
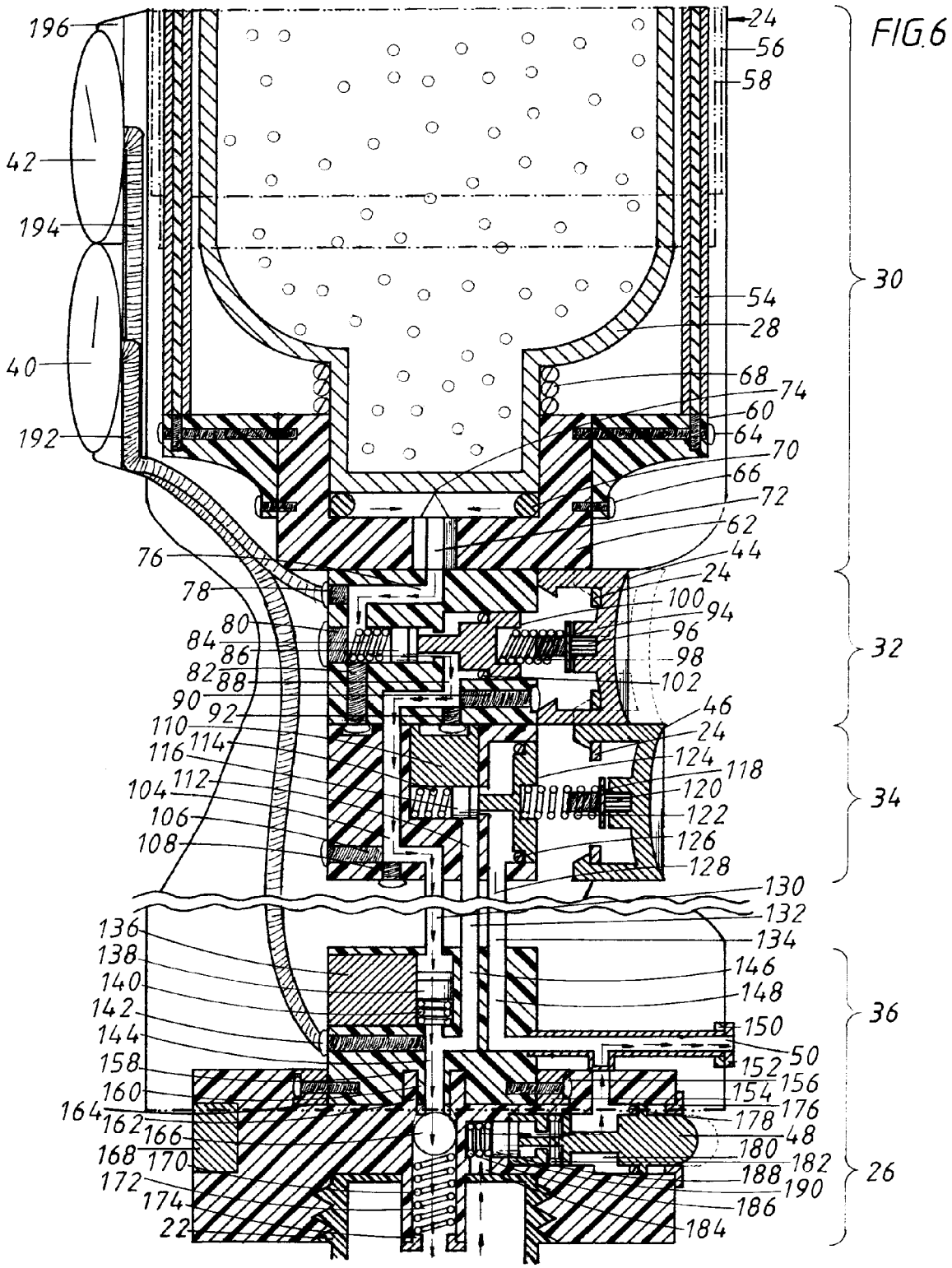

FIG. 6 is a front cross section view with portions removed of the sealing unit and charging unit docked to each other and the simultaneous flow of gas from the gas cartridge to the bottle and the evacuation of gas from the bottle.

Figure 7:
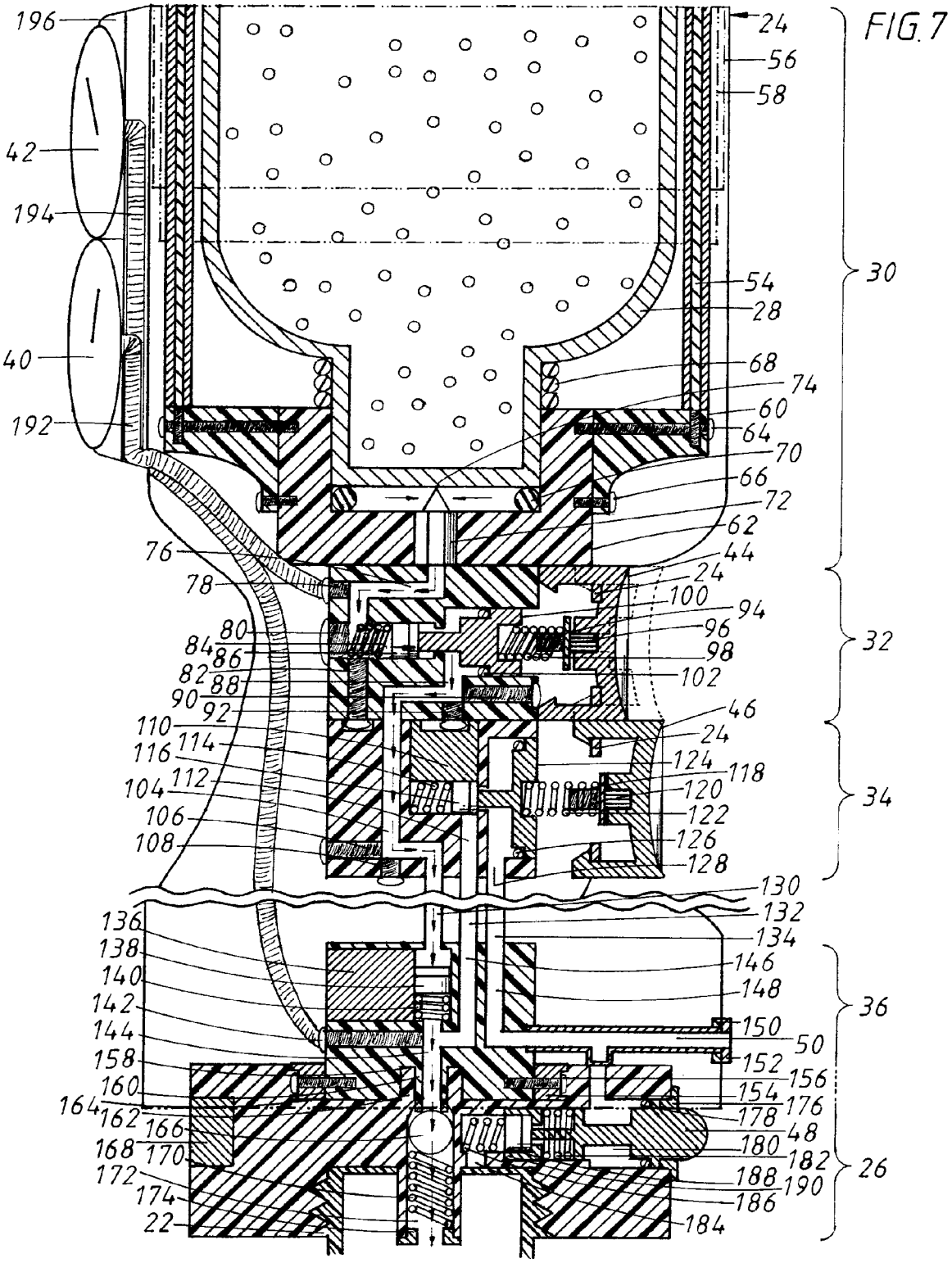

FIG. 7 is a front cross section view with portions removed of the sealing unit and charging unit docked to each other and the flow of gas from the gas cartridge to the bottle.

Figure 8:
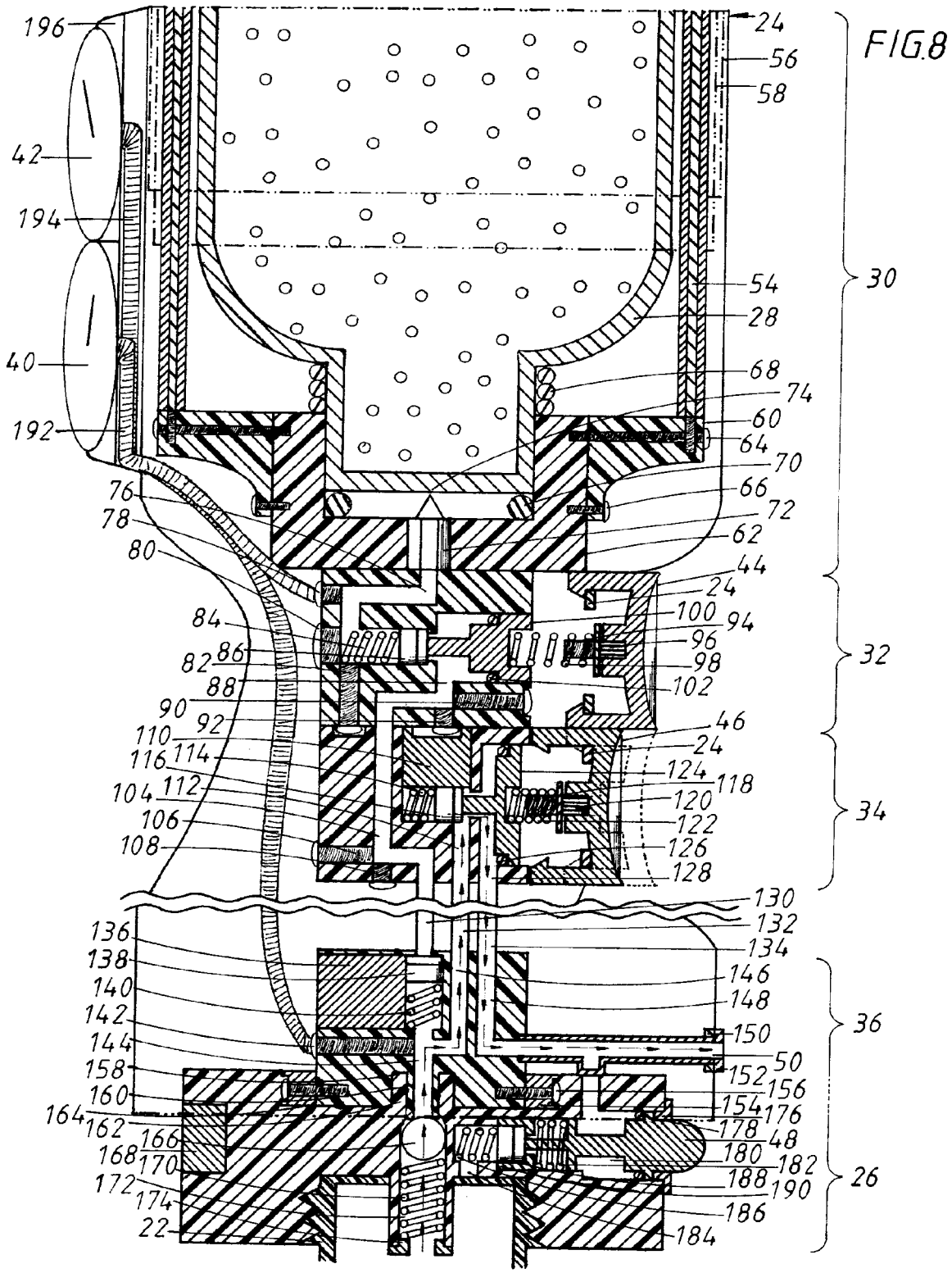

FIG. 8 is a front cross section view with portions removed of the sealing unit and charging unit docked to each other and the flow of gas from the bottle to atmosphere.

REFERENCE NUMERALS

| | | | |
|---|---|---|---|
| 20 | system | 22 | bottle |
| 24 | charging unit | 26 | sealing-valve unit |
| 28 | gas cartridge | 30 | gas cartridge housing assembly |
| 32 | charging-valve assembly | 34 | evacuating-valve assembly |
| 36 | transition-valve assembly | 38 | charging unit cap |
| 40 | gas cartridge pressure gage | 42 | bottle pressure gage |
| 44 | charging trigger | 46 | evacuating trigger |
| 48 | priming button | 50 | evacuation tube |

-continued

| | | | |
|---|---|---|---|
| 52 | cradle-cap mount | 54 | telescopic cradle bolts |
| 56 | cradle | 58 | gas cartridge sheath |
| 60 | housing wings | 62 | housing body |
| 64 | upper wing screw | 66 | lower wing screw |
| 68 | gas cartridge spring | 70 | gas cartridge sealing gasket |
| 72 | piercing element | 74 | diaphragm |
| 76 | pre-valve charging chamber | 78 | gas cartridge gage screw |
| 80 | charging chamber spring screw | 82 | first sealing screw |
| 84 | charging-valve spring | 86 | disk-shaped charging-valve plug |
| 88 | post-valve charging chamber | 90 | second sealing screw |
| 92 | third sealing screw | 94 | charging calibration screw |
| 96 | charging calibration disc nut | 98 | charging calibration spring |
| 100 | charging-valve piston | 102 | first piston o-ring |
| 104 | secondary charging chamber | 106 | fourth sealing screw |
| 108 | fifth sealing screw | 110 | pre-valve evacuating chamber seal |
| 112 | pre-valve evacuating chamber | 114 | evacuating-valve spring |
| 116 | disk-shaped evacuating-valve plug | 118 | evacuation calibration screw |
| 120 | evacuation calibration disc nut | 122 | evacuation calibration spring |
| 124 | evacuating-valve piston | 126 | second piston o-ring |
| 128 | post-valve evacuating chamber | 130 | ext. secondary charging chamber |
| 132 | ext. pre-valve evacuating chamber | 134 | ext. post-valve evacuating chamber |
| 136 | post-valve transition chamber seal | 138 | disk-shaped transition-valve plug |
| 140 | transition-valve spring | 142 | bottle gage screw |
| 144 | post-valve transition chamber | 146 | pre-valve evacuating branch |
| 148 | secondary evacuating chamber | 150 | evacuation tube inner connector |
| 152 | evacuation tube outer connector | 154 | keg-type male connector |
| 156 | keg-type male connector screw | 158 | transition chamber gasket |
| 160 | transition chamber tube | 162 | sealing-valve tube |
| 164 | keg-type female connector | 166 | sealing-valve ball |
| 168 | sealing-valve counter balance | 170 | sealing-valve spring |
| 172 | sealing-valve chamber | 174 | sealing-valve spring retention plug |
| 176 | priming button retention plug | 178 | priming button o-ring |
| 180 | post-valve priming chamber | 182 | priming button spring |
| 184 | pre-valve priming chamber | 186 | priming chamber spring |
| 188 | disk-shaped priming valve plug | 190 | priming chamber retention plug |
| 192 | gas cartridge pressure hose | 194 | bottle pressure hose |
| 196 | gage bezel | | |

Detailed Description of the First Embodiment

FIGS. 1-3 and 5

System

Figure 1:
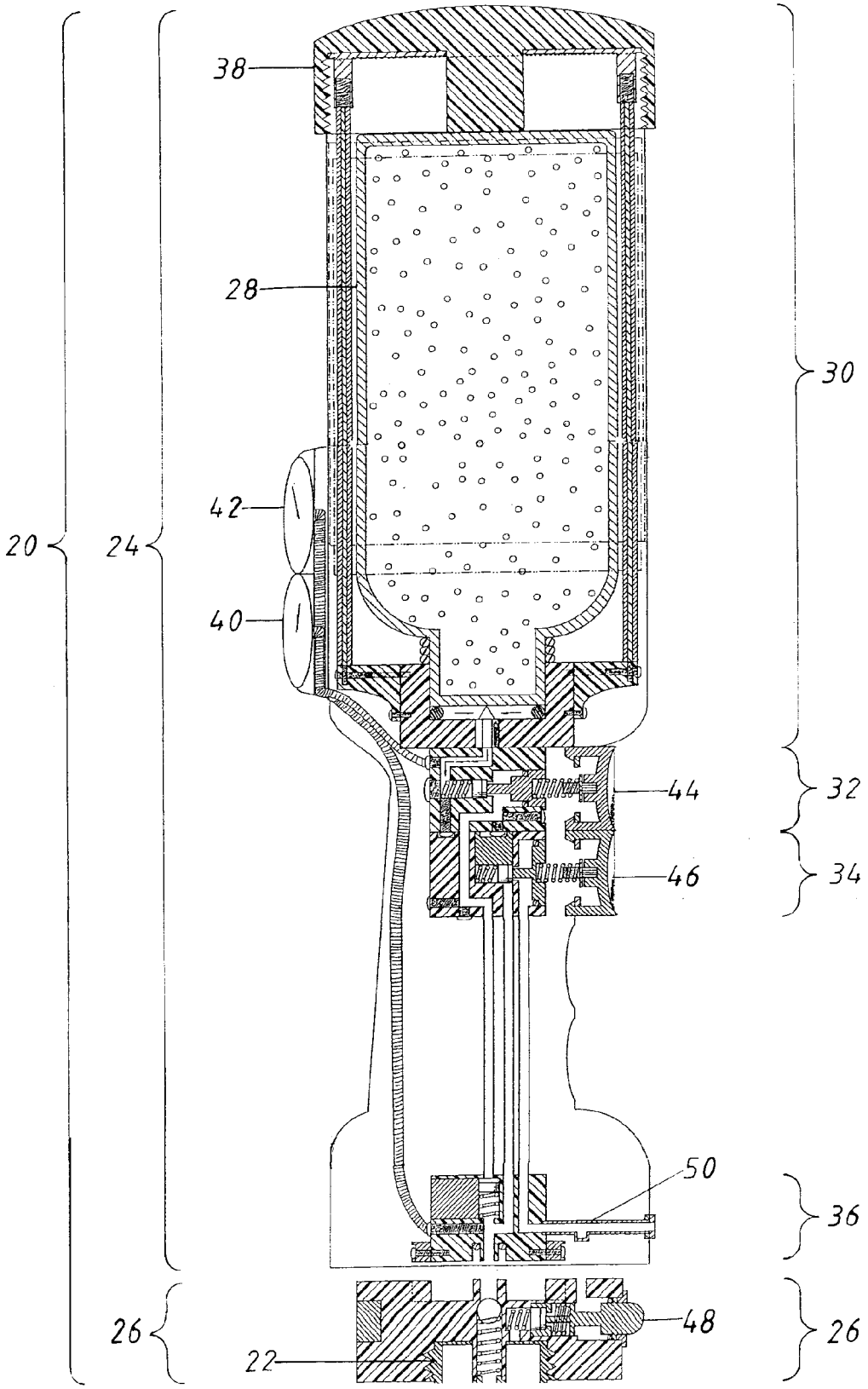
FIG. 1 is a front cross sectional view of the inventive device.

Referring to FIG. 1, The first embodiment provides a system 20 for the pressurization and evacuation of the gas contents of a bottle 22. The system 20 has seven major components. The system 20 comprises a hand-held pressurizing device, referred to herein as a charging unit 24, and a sealing-valve unit 26. The charging unit 24 has six major components, a gas cartridge housing assembly 30 (containing a separable gas cartridge 28), a charging-valve assembly 32, an evacuating-valve assembly 34, a transition-valve assembly 36, a gas cartridge pressure gage 40 and a bottle pressure gage 42. The sealing-valve unit 26 is the, singular and separable, seventh major component of the system 20.

The gas cartridge housing assembly 30 is directly connected to the charging-valve assembly 32, which in turn, is directly connected to the evacuating-valve assembly 34 via 4 transverse bolts (not shown) or some industrial joining method. The evacuating-valve assembly 34 and the transition-valve assembly 36 are connected by 3 transverse extended tubes (discussed later). The gas cartridge housing assembly 30 (the contained separable gas cartridge 28), the charging-valve assembly 32, the evacuating-valve assembly 34, the transition-valve assembly 36, and the sealing-valve unit 26 generally have a cylindrical shape (not shown).

The charging-valve assembly 32 includes a charging trigger 44 which allows the user to manually inject controlled amounts of gas into the bottle 22 during the charging phase. The evacuating-valve assembly 34 includes an evacuating trigger 46 which allows the user to manually evacuate the gas contents of the bottle 22, in a controlled manner, during the evacuating phase. The sealing-valve unit 26 includes a priming button 48 which allows the user to manually evacuate the ambient gas contents of the bottle 22 during the priming phase. The charging-valve assembly 32 is connected to the gas cartridge pressure gage 40 which allows the user to monitor the remaining amount of gas in the gas cartridge 28. The pressure gage 40 is the structure that provides the pressure indicating means to continuously monitor the gas pressure in the gas cartridge 28. The transition-valve assembly 36 is connected to the bottle pressure gage 42 which allows the user to monitor the pressure of the bottle 22 during the charging phase and evacuating phase of the gas in the bottle 22. The pressure gage 42 is the structure that provides the pressure indicating means in fluid communication with the bottle for continuously monitoring the gas pressure in the bottle.

The first embodiment may use a mixture of CO2 and N2 to achieve the initial ambient gas condition of an unopened bottle 22 of soda. Different or additional gases may be used for said purpose. A second embodiment may use Argon gas to achieve the initial ambient gas condition of a bottle 22 of wine. Different or additional gases may be used for said purpose. Additional embodiments may be used to achieve the initial ambient gas conditions of beer with a screw top, Champaign or sparkling water. Additional future embodiments are also not limited by gas type, gas mixture, and container types described here. Also, the first embodiment may be able to re-carbonate a flat beverage.

The first embodiment may use a female screw to mate with the male screw of a 2-liter bottle 22. A second embodiment may use a cork style sealing-valve unit 26 to mate with a wine bottle 22. Additional future embodiments are not limited by container mating types described here.

Gas Cartridge Housing Assembly

Referring to FIGS. 1-3 and 5, the first major component of the system 20 is the gas cartridge housing assembly 30. The assembly is comprised of a charging unit cap 38 (likely plastic). The charging unit cap 38 is cylindrical and about 3 inches wide (for future reference all dimensions of the system 20 are roughly equal to the dimensions of FIGS. 2, 3). The charging unit cap 38 is threadingly mated to the charging unit body 24 (likely plastic). The charging unit body 24 is slightly less than 3 inches wide. The long thread of the charging unit cap 38 is the first safety feature of the gas cartridge housing assembly 30. If a puncture type gas cartridge 28 is used, a premature decoupling of the gas cartridge 28 from the gas cartridge housing assembly 30 will not cause a catastrophic ejection of the high pressure gas cartridge 28. A user will not be able to unscrew the charging unit cap 38 fast enough to eject the gas cartridge 28 before all the gas is expelled from the gas cartridge 28.

The charging unit cap 38 is rotationally mated to a cradle-cap mount 52 (likely plastic). The cradle-cap mount 52 is threadingly mated to four transverse telescopic cradle bolts 54 (likely metal). The telescopic cradle bolts 54 are industrially secured to a male keyed cradle 56 (likely plastic), illustrated by the outer dotted line. A female keyed gas cartridge sheath 58 (likely plastic) is glued or industrially bonded to the gas cartridge 28 (commonly metal) and securely seated in the cradle 56. The cartridge sheath 58 is illustrated by the inner dotted line. The cartridge sheath 58 may be of octagonal form. The cartridge sheath 58 and cradle 56 perform four functions. First, the cartridge sheath 58 and cradle 56, when coupled with the telescopic cradle bolts 54, comprise the second safety feature. If the first long thread safety feature is compromised, the extended telescopic cradle bolts 54 coupled to the charging unit cap 38 will physically stop the gas cartridge 28 from rocketing out of the charging unit 24. The male keyed cradle 56 and female keyed gas cartridge sheath 58 will also help keep this from happening. Second, the cartridge sheath 58 protects the hand from a very cold gas cartridge 28 after a powerful endothermic reaction affects the gas cartridge 28 during charging. Third, the cartridge sheath 58 provides a surface for commercial advertising. Fourth, the male keyed cradle 56 and the female keyed gas cartridge sheath 58 act as a security feature against unauthorized gas cartridges 28.

The telescopic cradle bolts 54 are also threadingly mated to a housing wing 60 (likely plastic). The housing wing 60 is joined to a housing body 62 (for the purposes of illustration a pressure resistant, resilient material is used that can be bored out, however other materials and industrial processes may be applied) via four upper wing screws 64 and four lower wing screws 66. The cylindrical housing body 62 is 48/32 of an inch in diameter and 24/32 of an inch in depth. Upon insertion of the gas cartridge 28 in the cradle 56, the telescopic cradle bolts 54 are collapsed and the shoulder of the gas cartridge 28 makes contact with a gas cartridge spring 68. This is a slow smooth process as the long threads of the charging unit cap 38 are screwed down. The gas cartridge spring 68 and the long threads of the charging unit cap 38 make up the third safety feature. A gas cartridge sealing gasket or O-ring 70 seated between the head of the gas cartridge 28 and the receptor portion of the housing body 62 create an air tight seal. A hollow piercing element 72 (likely metal) centrally seated at the top of the housing body 62 pierces a diaphragm (not well illustrated) 74 of the gas cartridge 28 as the charging unit cap 38 is screwed down against smooth tension from the gas cartridge spring 68 (the piercing element 72 may take several forms; the function of each is to puncture the diaphragm 74 and release gas from the cartridge 28 into the charging-valve assembly 32). The third safety feature operates, such that, the gas cartridge 28 does not make premature contact with the piercing element 72, via the long screw down of the charging unit cap 38 against the smooth tension of the gas cartridge 28 facilitated by the gas cartridge spring 68.

An alternate embodiment may use a "paint ball gun" style threaded and regulated gas cartridge 28. In which case, most, if not all of the said safety features are unnecessary. Additional future embodiments are not limited by gas cartridge 28 mating types described here. Also, additional future embodiments are not limited by gas cartridge 28 shapes and sizes illustrated here.

Charging-Valve Assembly

The second major component of the system 20 is the charging-valve assembly 32 (for the purposes of illustration a pressure resistant, resilient material is used that can be bored out, however other materials and industrial processes may be applied). The cylindrical charging-valve assembly 32 is one inch in diameter and 24/32 of an inch in depth. The gas cartridge housing assembly 30 is directly connected to the charging-valve assembly 32 via 4 transverse bolts (not shown) or some industrial joining method.

The small bore of a pre-valve charging chamber 76 starts at the piercing element 72 at the top center of the cylindrical charging-valve assembly 32 (all small bores are 3/32 of an inch). The small bore of the pre-valve charging chamber 76 descends 5/32 of an inch, makes a left turn and runs 12/32 of an inch into a lateral hollow gas cartridge gage screw 78 (gage screws and sealing screws are inserted for pressure integrity after a bore based assembly process). The hollow gas cartridge gage screw 78 is 3/32 of an inch long (gage screws and sealing screws thread 3/32 of an inch bore unless otherwise noted). The small bore of the pre-valve charging chamber 76 descends again 9/32 of an inch and is abutted on the left by a lateral charging chamber spring screw 80 that is 3/32 of an inch long threading a bore diameter of 5/32 of an inch. The small bore of the pre-valve charging chamber 76 also runs into a vertical first sealing screw 82 that is 10/32 of an inch long. The small bore opens into the large bore of the pre-valve charging chamber 76 at the charging chamber spring screw 80. The large bore is 13/32 of an inch long and 5/32 of an inch in bore diameter. The large bore contains a charging-valve spring 84 and a disk-shaped charging-valve plug 86 (other configurations are possible for all plugs here-in described, such as a homogeneous hardened elastomeric disk or even a simple ball valve arrangement). The charging-valve spring 84 braces against the charging chamber spring screw 80 holding the disk-shaped charging-valve plug 86 in place. The disk-shaped charging-valve plug 86 has an elastomeric portion at the tip that forms the pressure seal, and a rigid portion at its base that braces against the charging-valve spring 84.

Past the disk-shaped charging-valve plug 86 which is seated in the pre-valve charging chamber 76 is the large bore of a post-valve charging chamber 88. A spatial bore 2/32 of an inch long and 4/32 of an inch in bore diameter, separates the two chambers, gives the disk-shaped charging-valve plug 86 something to brace against in order to form a seal.

The large bore of the post-valve charging chamber 88 is bored from the right side of the charging-valve assembly 32 14/32 of an inch long and 11/32 of an inch bore diameter. The small bore of the post-valve charging chamber 88 starts at the center left most portion of the large bore and descends 4/32 of an inch abutting a lateral second sealing screw 90 that measures 11/32 of an inch long on the right and runs into a vertical third sealing screw 92 that runs 3/32 of an inch long. The small bore of the post-valve charging chamber 88 then turns left and precedes 9/32 of an inch. The small bore of the post-valve charging chamber 88 then descends 3/32 of an inch intersecting a secondary charging chamber 104.

The charging trigger 44 is 24/32 of an inch long. The charging trigger 44 is screwed into and/or industrially bonded to a charging calibration screw 94, A charging calibration disc nut 96 rides on the charging calibration screw 94 to pre-determine and fine tune the pressure level of a gas injected into the bottle 22. In order to facilitate this, the charging calibration disc nut 96 compresses a charging calibration spring 98. The charging calibration spring 98 is also compressed, on the opposite end, by a charging-valve piston 100. The charging calibration spring 98 is selected so that it provides the proper spring pressure to the charging-valve piston 100. To accomplish this, the spring 98 is preferably a progressive spring with a variable spring rate and will be selected to provide the proper spring pressure when rotating the charging calibration disc nut 96. The charging trigger 44, charging calibration screw 94, charging calibration disc nut 96, charging calibration spring 98 and charging-valve piston 100 are the structure that performs the function of calibration means for setting a predetermined pressure in the bottle. The charging-valve piston 100 makes contact with the disk-shaped charging-valve plug 86 within the large bore of the post-valve charging chamber 88 through the previously mentioned spatial bore (an alternate embodiment may use a diaphragm and a separate valve actuator rod). A first piston o-ring or gasket 102 creates an air tight seal between the charging-valve piston 100 and the large bore of the post-valve charging chamber 88.

The charging trigger 44 allows the user to inject a controlled amount of gas into the bottle 22. The charging trigger 44 also lets the user set the pre-determined gas level for the bottle 22 by adjusting the charging calibration disc nut 96. In Applicant's invention the user is able to adjust the automatic pressure setting with the calibration disc nut 96. Adjustments for altitude, ambient air pressure, ambient temperature and differing unopened bottle 22 pressures by brand and bottling company can be adjusted for in the field. Additionally this adjustment may be precisely set through the use of the bottle pressure gage 42. This is necessary to approximately reach the ambient pressure conditions of a previously unopened container.

Although not illustrated, the disk-shaped charging-valve plug 86 may be provided with radial grooves transversing the entire plug 86. Additionally, the terminal end of the small bore, on the pre-valve charging chamber 76 side, tapers, to present, the smallest surface area of small bore edge, to the disk-shaped charging valve plug 86. Alternatively, the charging-valve piston 100 head can be screwed into the charging-valve plug 86, providing radial support for the plug where the large bore of the pre-valve charging chamber 76 will be radially larger than the charging-valve plug 86. The small bore taper complements this alternative embodiment. The intent is that the system operate like a Schrader or American valve where the extreme pressure exerted by the gas cartridge 28 is minimized as a force to keep the charging-valve plug 86 in place when acted on by the charging-valve piston 100. Other valve types may be used that achieve this same result.

Evacuating-Valve Assembly

The third major component of the system 20 is the evacuating-valve assembly 34 (for the purposes of illustration a pressure resistant, resilient material is used that can be bored out, however other materials and industrial processes may be applied). The cylindrical evacuating-valve assembly 34 is one inch in diameter and 24/32 of an inch in depth. The charging-valve assembly 32 is directly connected to the evacuating-valve assembly 34 via 4 transverse bolts (not shown) or some industrial joining method.

The small bore of the post-valve charging chamber 88 intersects the small bore of the secondary charging chamber 104 in the evacuating-valve assembly 34 creating a pressure tight seal. The small bore of the secondary charging chamber 104 descends 21/32 of an inch and is abutted on the left by a lateral fourth sealing screw 106 8/32 of an inch long. The secondary charging chamber 104 also runs into a vertical fifth sealing screw 108 3/32 of an inch long. The small bore of the secondary charging chamber 104 then makes a right turn and continues 7/32 of an inch. The small bore of the secondary charging chamber 104 then descends 3/32 of an inch and intersects an extended secondary charging chamber 130 creating an air tight seal.

A pre-valve evacuating chamber seal 110 is situated 2/32 of an inch to the right of the secondary charging chamber 104 at the top center of the evacuating-valve assembly 34. The pre-valve evacuating chamber seal 110 is 10/32 of an inch long by 9/32 of an inch deep. The pre-valve evacuating chamber seal 110 is necessary to create the large bore of a pre-valve evacuating chamber 112. The large bore of the pre-valve evacuating chamber 112 is 10/32 of an inch long by 5/32 of an inch in bore diameter. An evacuating-valve spring 114 and a disk-shaped evacuating-valve plug 116 sit below the pre-valve evacuating chamber seal 110 in the large bore of the pre-valve evacuating chamber 112. The disk-shaped evacuating-valve plug 116 has an elastomeric portion at the tip that forms the pressure seal, and a rigid portion at its base that braces against the evacuating-valve spring 114. Past the disk-shaped evacuating-valve plug 116 which is seated in the pre-valve evacuating chamber 112 is the large bore of a post-valve evacuating chamber 128. A spatial bore 2/32 of an inch long and 4/32 of an inch in bore diameter, separates the two chambers, gives the disk-shaped evacuating-valve plug 116 something to brace against in order to form a pressure seal. The pre-valve evacuating chamber 112 descends 10/32 of an inch at the right most of the large bore of the pre-valve evacuating chamber 112 and intersects an extended pre-valve evacuating chamber 132 forming a pressure seal.

The evacuating trigger 46 is 24/32 of an inch long. The evacuating trigger 46 is screwed into and/or industrially bonded to an evacuation calibration screw 118. An evacuation calibration disc nut 120 rides on the evacuation calibration screw 118 to adjust the tension on the evacuating trigger 46. In order to facilitate this, the evacuation calibration disc nut 120 compresses an evacuation calibration spring 122. The evacuation calibration spring 122 may be the same type spring as the charging calibration spring 98 to maintain uniform trigger feel. The evacuation calibration spring 122 is also compressed, on the opposite end, by an evacuating-valve piston 124. Said evacuating-valve piston 124 makes contact with the disk-shaped evacuating-valve plug 116 within the large bore of the post-valve evacuating chamber 128 through the previously mentioned spatial bore. A second piston o-ring or gasket 126 creates an air tight seal between the evacuating-valve piston 124 and the large bore of the post-valve evacuating chamber 128. The post-valve evacuating chamber 128 descends 3/32 of an inch from the left most of the large bore of the post-valve evacuating chamber 128 and intersects an extended post-valve evacuating chamber 134 forming an air tight seal. In an alternate embodiment that is not illustrated, the evacuating-valve assembly 34, like the charging-valve assembly 32, may have a Schrader type valve system to ensure proper function and/or to maintain uniform trigger feel. Other valve types may be used to achieve a similar result.

The evacuating trigger 46 allows the user to evacuate a controlled amount of gas from the bottle 22. This function will likely be used when the bottle 22 is over-pressurized. This function does not exist in prior art. Also, the user is able to monitor this function through the use of the bottle pressure gage 42. This is necessary to approximately reach the ambient pressure conditions of a previously unopened container.

Transition-Valve Assembly

The fourth major component of the system 20 is the transition-valve assembly 36 (for the purposes of illustration a pressure resistant, resilient material is used that can be bored out, however other materials and industrial processes may be applied). The cylindrical transition-valve assembly 36 is one inch in diameter and 24/32 of an inch in depth. The extended secondary charging chamber 130, the extended pre-valve evacuating chamber 132, and the extended post-valve evacuating chamber 134 all extend for 74/32 of an inch, hermetically connecting the evacuating-valve assembly 34 to the transition-valve assembly 36. This is done in order for the charging unit 24 to have a hand gripping portion.

The extended secondary charging chamber 130 descends into the large bore of a post-valve transition chamber 144 through a spatial aperture 3/32 of an inch wide by 1/32 of an inch deep. The large bore of the post-valve transition chamber 144 is abutted by a post-valve transition chamber seal 136 necessary for bore assembly. The post-valve transition chamber seal 136 is 15/32 of an inch long by 11/32 of an inch deep. The post-valve transition chamber 144 is 5/32 of an inch bore diameter by 11/32 of an inch deep. Within the large bore of the post-valve transition chamber 144 a disk-shaped transition-valve plug 138 is held in place by a transition-valve spring 140 in order to create a seal between the extended secondary charging chamber 130 and the large bore of the post-valve transition chamber 144. The said spatial aperture creates a surface for the disk-shaped transition-valve plug 138 to brace against in order to create an air tight seal. The disk-shaped transition-valve plug 138 has an elastomeric portion at the tip that forms the pressure seal, and a rigid portion at its base that braces against the transition-valve spring 140. The force applied by the transition-valve spring 140 may be selected so that only a slight pressure differential will open the disk-shaped transition-valve plug 138. This should aid the fine calibration utilized in the charging function.

A small bore of the post-valve transition chamber 144 continues to descend 5/32 of an inch and is abutted by a hollow bottle gage screw 142 15/32 of an inch long on the left and the small bore of a pre-valve evacuating branch 146. The pre-valve evacuating branch 146 continues right 5/32 of an inch then ascend 14/32 of an inch until it intersects with the extended pre-valve evacuating chamber 132 forming an air tight seal. The small bore of the post-valve transition chamber 144 continues to descend 8/32 of an inch until it reaches an exit aperture or transition chamber tube 160.

The extended post-valve evacuating chamber 134 descends and intersects a secondary evacuating chamber 148. The secondary evacuating chamber 148 descends 16/32 of an inch turns right and runs 5/32 of an inch intersecting an evacuation tube 50. The evacuation tube 50 runs 8/32 of an inch then branches downward, near its middle, to mate with a small bore of a post-valve priming chamber 180 when the charging unit 24 is docked with the sealing-valve unit 26. The branch descends 2/32 of an inch. The evacuation tube 50 continues to an exit aperture 16/32 of an inch past the branch. The evacuation tube 50 is held in place by an evacuation tube inner connector 150 and an evacuation tube outer connector 152 situated on the charging unit 24.

The transition chamber tube 160 is 1/32 of an inch thick and surrounded by a transition chamber gasket or O-ring 158 to facilitate an air tight seal during docking. On either side of the bottom of the transition-valve assembly 36 are two keg-type male connectors 154 held in place by four keg-type male connector screws 156 which also facilitate docking.

Gages

The fifth and sixth major components of the system 20 are the bottle pressure gage 42 and the gas cartridge pressure gage 40, respectively.

A gage bezel 196 is attached to the charging unit 24 above the grip portion of said charging unit 24. At the top of the gage bezel 196, is inserted, the bottle pressure gage 42 one inch in diameter (size and shape may vary in future embodiments). The bottle pressure gage 42 is connected to a bottle pressure hose 194. The bottle pressure hose 194 runs down to the transition-valve assembly 36 and connects to the hollow bottle gage screw 142. The bottle pressure gage 42 is mentioned in Heitel's embodiment—in passing. However, the gage attaches to a portion of his embodiment, analogous to the post-valve charging chamber 88, making it completely inoperable. Heitel would have to re-work his entire apparatus, approaching something akin to this embodiment, to make his bottle pressure gage 42 work properly. The bottle pressure gage 42 is necessary to achieve precise pressure levels in the bottle 22.

Below the bottle pressure gage 42 is seated the gas cartridge pressure gage 40 one inch in diameter (size and shape may vary in future embodiments) within the gage bezel 196. The gas cartridge pressure gage 40 is connected to a gas cartridge pressure hose 192. The gas cartridge pressure hose 192 runs down to the charging-valve assembly 32 and connects to the hollow gas cartridge gage screw 78.

Sealing-Valve Unit

The seventh major component of the system 20 is the sealing-valve unit 26 (for the purposes of illustration, a pressure resistant, resilient material, is used, that can be bored out, however, other materials and industrial processes may be applied). The cylindrical sealing-valve unit 26 is 74/32 of an inch in diameter and 27/32 of an inch in depth. The transition-valve assembly 36 docks with the sealing-valve unit 26, through a quarter, half, or three quarter degree turn, resembling the tapping of a keg. This is illustrated in FIG. 6. This docking connection is the structure that performs the function of attachment means for attacking in a fluid tight seal the top of the sealing cap to the charging unit and the bottom to the open top of the container.

A sealing-valve tube 162 is 2/32 of an inch thick, has a bore diameter of 5/32 and descends 7/32 of an inch from the top center of the sealing-valve unit 26. The sealing-valve tube 162 is flanked by two keg-type female connectors 164 at the top of the sealing-valve unit 26 which facilitate docking. The sealing-valve tube 162 descends 7/32 of an inch and intersects a sealing-valve ball 166 7/32 of an inch in diameter. The sealing-valve tube 162 also intersects a sealing-valve chamber 172 which widens to 7/32 of an inch to accommodate the sealing-valve ball 166. The sealing-valve ball 166 creates an air tight seal between the sealing-valve tube 162 and the sealing-valve chamber 172 when the charging unit 20 and sealing valve unit 26 are separate. When the two units 20 and 26 are attached, the sealing-valve ball 166 is mechanically displaced and held in the open or non sealing position. Thus, when the two units are attached, pressure changes and directional flow of gas will not affect the sealing-valve ball 166. Although a sealing-valve ball is illustrated, a pin type valve or other type valve that achieves the purpose that is intended may also be used. The sealing-valve ball 166 is held in place by a sealing-valve spring 170. The sealing-valve ball 166 and spring 170 reside within the large bore of the sealing-valve chamber 172. The sealing-valve chamber 172 continues to descend 18/32 of an inch to an exit aperture and a sealing-valve spring retention plug 174 which holds the sealing-valve spring 170 in place. The bottom tube portion of the sealing-valve chamber 172 is 2/32 of an inch thick and also distends into the bottle 22. The bottle 22 is threadingly mated to the sealing-valve unit 26.

On the right central portion of the sealing-valve unit 26, 11/32 of an inch above its base, is seated the priming button 48. The priming button 48 is held in place by a priming button retention plug 176 which is braced against the charging unit 24. The priming button 48 is seated within the large bore of the post-valve priming chamber 180. The large bore of the post-valve priming chamber 180 is 26/32 of an inch long and 11/32 of an inch in bore diameter which narrows to 9/32 of an inch in bore diameter 12/32 of an inch in.

At the base of the narrowing of the bore a small bore of the post-valve priming chamber 180 ascends 5/32 of an inch to mate with the branch of the evacuation tube 50 when the sealing-valve unit 26 is docked with the transition-valve assembly 36. The connection might or might not be completely air tight.

Digressing, a priming button o-ring 178 sits between the priming button 48 and the post-valve priming chamber 180 creating an air tight seal within the large bore of the post-valve priming chamber 180. A priming button spring 182 sits between the piston-portion of the priming button 48 and a priming chamber retention plug 190 to facilitate smooth button motion. The priming chamber retention plug 190 is seated at the left most of the post-valve priming chamber 180 and resists the priming button spring 182. The priming chamber retention plug 190 also creates the right most large bore of a pre-valve priming chamber 184. The pre-valve priming chamber 184 is 11/32 of an inch long with a bore diameter of 5/32 of an inch. The large bore of the pre-valve priming chamber 184 contains a disk-shaped priming valve plug 188 held in place by a priming chamber spring 186. The disk-shaped priming valve plug 188 has an elastomeric portion at the tip that forms the pressure seal, and a rigid portion at its base that braces against the priming chamber spring 186. The elastomeric portion of the disk-shaped priming valve plug 188 braces against the priming chamber retention plug 190 creating an air tight seal. A spatial aperture 2/32 of an inch long by 3/32 of an inch in bore diameter is situated at the center of the priming chamber retention plug 190 allowing the piston portion of the priming button 48 to make contact with the disk-shaped priming valve plug 188.

The small bore of the pre-valve priming chamber 184 is located within 1/32 of an inch from the left most of the large bore of the pre-valve priming chamber 184. The small bore of the pre-valve priming chamber 184 descends 4/32 of an inch into an exit aperture into the bottle 22.

On the left central portion of the sealing-valve unit 26 is seated a sealing-valve counter balance 168. The sealing-valve counter balance 168 counterbalances the weight of the apparatus on the right side of the sealing-valve unit 26.

The priming function of the sealing-valve unit 26 is a necessary function to remove ambient air from the bottle 22 before a pure gas (type or mixture) from the gas cartridge 28 is used to pressurize the bottle 22. The function is achieved by holding the priming button 48 while depressing the charging trigger 44 for a brief period. The priming button 48 provides the structure for manually operating the disk-shaped priming valve plug 188, priming chamber retention plug 190, priming button spring 182, and priming chamber spring 186 for opening and closing the disk-shaped valve plug 188 for allowing the flow of gas from the pre-valve priming chamber 184 to the post-valve priming chamber 180. This creates a high speed pressure injection of gas from the gas cartridge 28 straight down into the bottle 22. The ambient air in the bottle 22 is forced out the top through the pre-valve priming chamber 184, the post-valve priming chamber 180, and the evacuation tube 50 into the surrounding air. This function cannot be performed by the evacuating trigger 46 as it feeds into the post-valve transition chamber 144. Again as previously described, a Schrader type valve, contemplated in the charging-valve assembly 32, and the evacuating-valve assembly 34, may be used in the pre-valve priming chamber 184 and/or the post-valve priming chamber 180 to make the disk-shaped priming valve plug easier to unseat. Other valve types may be used to achieve a similar result.

Operation

FIGS. 2-3 and 5-8

Cartridge Insertion

Figure 2:
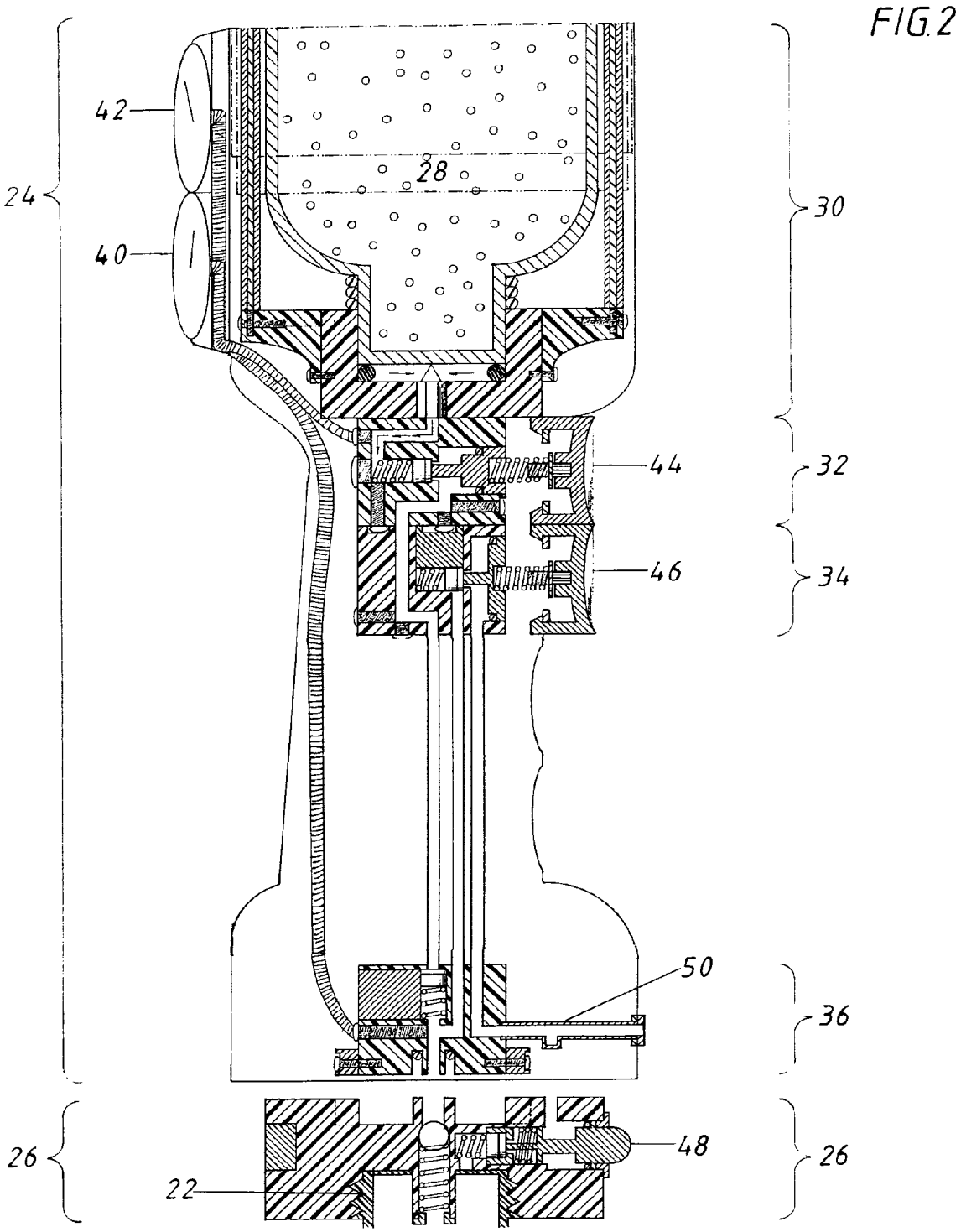
FIG. 2 is a cross sectional view of the lower portion of the inventive device with portions removed.
Figure 3:
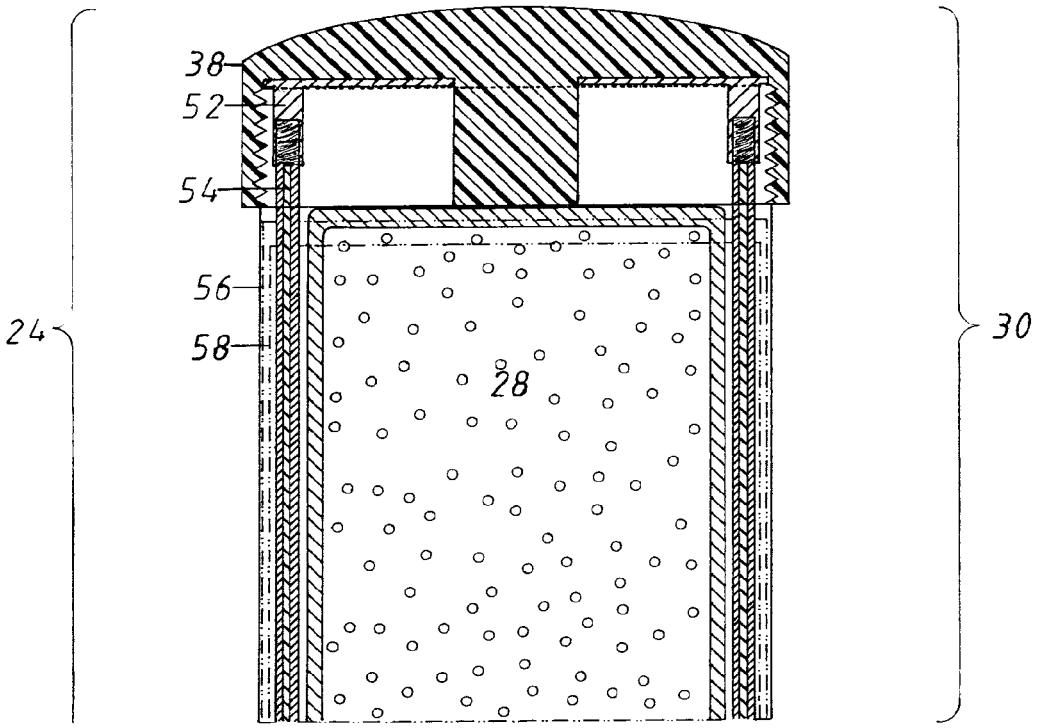
FIG. 3 is a front cross sectional view of the upper portion of the inventive device with portions removed.

Referring to FIGS. 2, 3 and 5, the charging unit cap 38 is unscrewed from the long threads of the charging unit 24. The cradle-cap mount 52 spins as the charging unit cap 38 is unscrewed. The charging unit cap 38 is gripped and pulled away from the charging unit 24. The telescopic cradle bolts 54 extend to their full length. The cradle 56 rides on the telescopic cradle bolts 54 extending away from the charging unit 24. The gas cartridge 28, surrounded by the gas cartridge sheath 58, is inserted into the cradle 56. The male contacts of the cradle 56 dock with the female contacts of the gas cartridge sheath 58. The charging unit cap 38 is then pushed back towards the charging unit 24 as the telescopic cradle bolts 54 collapse. The charging unit cap 38, once again, makes contact with the long screws of the charging unit 24.

As the charging unit cap 38 is screwed down, the gas cartridge spring 68 comes in contact with the shoulder of the gas cartridge 28. The gas cartridge spring 68 compresses, and the diaphragm 74 of the gas cartridge 28 is pierced by the hollow piercing element 72, also referred to as gas releasing means 28, within the receptor portion of the housing body 62. The gas cartridge sealing gasket 70 maintains an airtight seal between the gas cartridge 28 and the receptor portion of the housing body 62. High pressure gas then travels through the hollow portion of the piercing element 72, into the small and large bore of the pre-valve charging chamber 76, and is stopped by the disk-shaped charging-valve plug 86.

High pressure gas also travels through the hollow gas cartridge gage screw 78, the gas cartridge pressure hose 192, and reaches the gas cartridge pressure gage 40. The pressure of the gas cartridge 28 is now able to be measured, continuously, until the gas cartridge 28 is removed from the gas cartridge housing assembly 30.

Although the above described embodiment illustrates a piercing element 72 piercing the diaphragm 74, other means can be used to release the gas from the gas cartridge 28 such as a Schrader valves or Presta valves or other valves that achieve this purpose. Accordingly all such valves or piercing mechanisms used to release the gas from the gas cartridge 28 are included in the description of gas releasing means 28.

Docking

Referring to FIGS. 5 and 6, the charging unit 24 docks with the sealing-valve unit 26 in a keg-type tapping manner. The charging unit 24 is lowered onto the sealing-valve unit 26. The transition chamber tube 160 inserts into the sealing-valve tube 162 and displaces the sealing-valve ball 166 by compressing the sealing-valve spring 170.

The transition chamber gasket 158 comes in contact with the top of the sealing-valve tube 162 creating an air tight seal. Incidentally, the bottle 22, the sealing-valve chamber 172, the sealing-valve tube 162, the transition chamber tube 160, the post-valve transition chamber 144, and the pre-valve evacuating branch 146 all share the bottle 22 pressure until the charging unit 24 and the sealing-valve unit 26 are undocked.

Also, the hollow bottle gage screw 142, the bottle pressure hose 194, and the bottle pressure gage 42, share the same bottle 22 pressure until the charging unit 24 and the sealing-valve unit 26 are undocked. This allows the user to, continuously, monitor bottle 22 pressure during the pressurizing and evacuating phase.

The docking is completed once the charging unit 24 and the sealing-valve unit 26 are locked in place. This occurs through a quarter, half, or three quarter degree turn which locks the keg-type male connector 154, of the charging unit 24, into the keg-type female connector 164 of the sealing-valve unit 26. A continuous air tight seal between the charging unit 24 and the sealing-valve unit 26 is thus created.

Docking is disengaged in the reverse manner. Pressure is maintained in the bottle 22 due to the tension from the sealing-valve spring 170 on the sealing-valve ball 166. This recreates an airtight seal upon charging unit 24 removal from the sealing-valve unit 26.

Priming Function

Referring to FIGS. 5 and 6, the charging trigger 44 is quickly depressed and released once, or several times, as the priming button 48 is continuously depressed.

The charging trigger 44 is depressed. The pre-set charging calibration disc nut 96 engages the charging calibration spring 98 which in turn engages the charging-valve piston 100. Incidentally, the pressure release will not exceed 70 psi and will automatically close at some set pressure below 70 psi due to the spring compression setting of the charging calibration disc nut 96. The rod portion of the charging-valve piston 100 unseats the disk-shaped charging-valve plug 86 by compressing the charging-valve spring 84. The charging-valve plug 86 is mainly seated in place by the charging-valve spring 84 due to the Schrader like valve arrangement. Very high pressure from the gas cartridge 28 acts as a minimum force to seat the charging-valve plug 86. High pressure gas is released, in a controlled manner, into the large bore of the post-valve charging chamber 88. The gas continues down the small bore of the post-valve charging chamber 88, the small bore of the secondary charging chamber 104, and the extended secondary charging chamber 130, until it reaches the disk-shaped transition-valve plug 138. The high pressure of the gas unseats the disk-shaped transition-valve plug 138 by compressing the transition-valve spring 140. The high pressure gas then travels down the large and small bore of the post-valve transition chamber 144, the transition chamber tube 160, and the sealing-valve tube 162. Incidentally, the pre-valve evacuating branch 146, the extended pre-valve evacuating chamber 132, and the pre-valve evacuating chamber 112 are charged, with the gas stopping at the disk-shaped evacuating-valve plug 116. The gas continues past the sealing-valve ball 166, down the sealing-valve chamber 172 and jets straight down into the bottle 22.

The gas jet in the bottle 22 forces the ambient gas into the pre-valve priming chamber 184. Because the priming button 48 is depressed, the ambient gas continues into the large and small bore of the post-valve priming chamber 180, the evacuation tube 50, and exits into the surrounding air. This occurs because the depression of the priming button 48 compresses the priming button spring 182 which in turn allows the rod portion of the priming button 48 to unseat the disk-shaped priming valve plug 188. The disk-shaped priming valve plug 188 is unseated because the pressure from the rod portion of the priming button 48 compresses the priming chamber spring 186. As described herein, the priming function is a combination of the charging function and a special evacuating function initiated simultaneously.

Charging Function

Referring to FIG. 7, the charging trigger 44 is quickly depressed and a pressure level is set either by reference to the bottle pressure gage 42 or the automatic cut-off function of the charging calibration disc nut 96.

The charging trigger 44 is depressed. The pre-set charging calibration disc nut 96 engages the charging calibration spring 98 which in turn engages the charging-valve piston 100. Incidentally, the pressure release will not exceed 70 psi and will automatically close at some set pressure below 70 psi due to the spring compression setting of the charging calibration disc nut 96. The rod portion of the charging-valve piston 100 unseats the disk-shaped charging-valve plug 86 by compressing the charging-valve spring 84. High pressure gas is released, in a controlled manner, into the large bore of the post-valve charging chamber 88. The gas continues down the small bore of the post-valve charging chamber 88, the small bore of the secondary charging chamber 104, and the extended secondary charging chamber 130, until it reaches the disk-shaped transition-valve plug 138. The high pressure of the gas unseats the disk-shaped transition-valve plug 138 by compressing the transition-valve spring 140. The high pressure gas then travels down the large and small bore of the post-valve transition chamber 144, the transition chamber tube 160, and the sealing-valve tube 162. Incidentally, the pre-valve evacuating branch 146, the extended pre-valve evacuating chamber 132, and the pre-valve evacuating chamber 112 are charged, with the gas stopping at the disk-shaped evacuating-valve plug 116. The gas continues past the sealing-valve ball 166, down the sealing-valve chamber 172 and jets straight down into the bottle 22 pressurizing it.

The injection of gas pressurizes the bottle 22 up to a predetermined limit, at which time the charging unit 24 will automatically shut of the flow of gas. This is accomplished by the provision of the charging calibration spring 98 between the charging trigger 44 and the charging valve piston 100. The inward force transmitted by the spring 98 to the piston 100 is resisted by the force applied in the opposite direction against the first piston o-ring 102 side of the piston by gas pressure within the post-valve charging chamber 88. This force thus is approximately equal to the cross-sectional area of the post-valve charging chamber 88 times the pressure.

At some point, the pressure within the bottle 22 will reach a predetermined value, and the pressure in the post-valve charging chamber 88 on the o-ring side of the piston 100 will be identical due to the open channel of communication via the post valve transition chamber 144 and the sealing-valve chamber 172 interaction. A pressure-generated force on the piston 100 greater than the charging calibration spring 98 force will cause the piston to re-tract. Concurrently, the rod of the piston 100 will also retract, eventually allowing the disk-shaped charging-valve plug 86 to again seal with the pre-valve charging chamber 76 valve seat. This stops the flow of the high pressure gas, thus limiting the maximum pressure delivered to the bottle 22. By adjusting the calibration disc 96, the force of the calibration spring 98 is adjusted which thus determines the maximum pressure that will be allowed to flow into the bottle 22.

Evacuating Function

Referring to FIG. 8, the evacuating trigger 46 is depressed. The pre-set evacuation calibration disc nut 120 engages the evacuation calibration spring 122 which in turn engages the evacuating-valve piston 124. Incidentally, trigger tension may vary due to the spring compression setting of the evacuation calibration disc nut 120. The rod portion of the evacuating-valve piston 124 unseats the disk-shaped evacuating-valve plug 116 by compressing the evacuating-valve spring 114. Bottle 22 pressure gas is released, in a controlled manner, from the pre-valve evacuating chamber 112 and released into the large bore of the post-valve evacuating chamber 128. The bottle 22 gas proceeds through the large and small bore of the post-valve evacuating chamber 128, the extended post-valve evacuating chamber 134, the secondary evacuating chamber 148, out the evacuation tube 50 into the surrounding air. Incidentally, some bottle 22 gas bleeds into the post-valve priming chamber 180 but is stopped at the disk-shaped priming valve plug 188 due to positive pressure from the bottle 22.

By engaging the above evacuating function, and squeeze compressing the 2-liter bottle 22, an alternate priming function may be achieved. Squeeze compressing forces all gas out of the reduced volume 2-liter bottle 22. Next, engaging the charging function will re-inflate the squeeze compressed 2-liter bottle, leaving only gas from the gas cartridge 28.

Alternative Cork Style Container Mating Type

In reference to FIG. 5, the sealing-valve unit 26 may utilized a rubber (or alternate material) stopper (not shown) in place of the female screws which mate the sealing-valve unit 26 to the male screws of the bottle 22. If a gas, such as argon, is used in place of the CO2 mixture in the first embodiment, an excellent wine preserver could exist in an alternate embodiment (note that gas or gas combinations are not limited to argon). The wine bottle 22 would be primed or evacuated of ambient air. Near pure Argon could be added under pressurized, or zero pressure conditions, via the priming charging and evacuating functions.

Alternative Double Priming Button

In reference to FIG. 5, the priming button 48, and all of its associated components could be mirrored on the opposite side in place of the sealing-valve counter balance 168. In essence, this would double the escape potential of the ambient air during the priming function. An alternate evacuation tube 50 would probably have to be installed, as well. This dual button arrangement could be activated by the thumb and forefinger of the user.

Alternative Siphon

In reference to FIG. 5, if either a single or double priming button 48 are used, a siphon could additionally be added to the sealing-valve unit 26. This would include a tube extending from the sealing-valve unit 26 into the liquid of the bottle 22. The tube would exit the sealing-valve unit 26 and be controlled by a manually released valve. This is almost completely analogous to a keg tap, and may be considered a new use of previous art. The advantage of this arrangement is that the sealing-valve unit 26 would never have to be uncoupled from the bottle 22 during the consumption period of the beverage.

Electric Air Pump

In reference to FIG. 1, a battery/cord operated electric air pump could be substituted for the gas cartridge 28.

Although this invention has been described in terms of the first embodiment, other embodiments that are apparent to those of ordinary skill in the art are also within the range of this invention. Accordingly, the scope of the invention is intended to be defined only by reference to the following claims.

What is claimed is:

1. A device for pressurizing a container that is at least partially filled with a liquid and a trapped gas comprising:

a charging unit comprising:

a hand held gas cartridge housing assembly;

a gas cartridge containing a pressurized gas mounted in the gas cartridge assembly, the gas cartridge having an exit port;

a piercing element for penetrating a sealing element in the gas cartridge to allow the pressurized gas to escape from the gas cartridge through the exit port;

a charging unit passageway having an inlet and an outlet, the inlet in fluid communication with the exit port of the gas cartridge;

a manually operated valve for controlling the flow of the pressurized gas through the charging unit passageway;

the manually operated valve for automatically stopping the flow of gas through the charging unit passageway when a predetermined pressure is attained in the container;

calibration means for setting the predetermined pressure, the calibration means connected to the manually operated valve;

a sealing cap having a top and a bottom with attachment means for attaching in a fluid tight seal the top of the sealing cap to the charging unit and the bottom to an open top of the container, the sealing cap having a sealing cap passageway in fluid communication with the charging unit passageway and the open top of the container;

a sealing cap valve mounted in the sealing cap passageway for controlling the flow of the pressurized gas through the sealing cap passageway into and out from the container;

a container charging passageway from the gas cartridge to the container formed by the charging unit passageway, manually operated valve, sealing cap passageway, and sealing cap valve;

an evacuation tube in fluid communication between the open top of the container and the atmosphere;

a container evacuation passageway with a priming valve mounted in the container evacuation passageway, the container, evacuation passageway extending from the open top of the container, through the priming chamber in the sealing cap to the evacuation tube for venting the gas from the container to the atmosphere when the priming valve is in an open position;

whereby in a first position the pressurized gas is released and fills the container above the liquid while the priming valve is in the open position allowing the gas above the liquid to vent to the atmosphere, and in a second gas filling position the priming valve is in a closed position and the pressurized gas fills the container to the predetermined pressure.

2. The device of claim 1 wherein the calibration means comprises a nut on a threaded shaft, the nut engaging a spring for adjusting the force that the spring applies to the valve to cause the valve to close when the predetermined pressure is reached.

3. The device of claim 1 wherein the sealing cap valve means mounted in the sealing cap restricts the flow of the pressurized gas from the container through the sealing cap passageway when the sealing cap is unattached from the charging unit.

4. The device of claim 1 wherein the priming valve has manually operated means for selectively opening the priming valve when the pressurized gas flows into the container with the pressurized gas purging the gas that is in the container to the atmosphere.

5. The device of claim 1 and further comprising a first trigger mechanism for opening the manually operated valve for controlling the flow of the pressurized gas through the charging unit passageway.

6. The device of claim 5 and further comprising a second trigger mechanism for controlling an alternate exhaust passageway from the container to the atmosphere through the sealing cap passageway to the evacuation tube.

7. The device of claim 1 and further comprising a pressure indicating means in fluid communication with the container for continuously monitoring the gas pressure in the container.

8. The device of claim 7 and further comprising a second pressure indicating means in fluid communication with the gas cartridge for continuously monitoring the gas pressure in the cartridge.

9. A device for pressurizing a container that is at least partially filled with a liquid and a trapped gas comprising:

a charging unit comprising:

a hand held gas cartridge housing assembly;

a gas cartridge containing a pressurized gas mounted in the gas cartridge assembly, the gas cartridge having an exit port;

a piercing element for penetrating a sealing element in the gas cartridge to allow the pressurized gas to escape from the gas cartridge through the exit port;

a charging unit passageway having an inlet and an outlet, the inlet in fluid communication with the exit port of the gas cartridge;

a manually operated valve for controlling the flow of the pressurized gas through the charging unit passageway;

the manually operated valve for automatically stopping the flow of gas through the charging unit passageway when a predetermined pressure is attained in the container;

calibration means for setting the predetermined pressure, the calibration means connected to the manually operated valve;

a sealing cap having a top and a bottom with attachment means for attaching in a fluid tight seal the top of the sealing cap to the charging unit and the bottom to an open top of the container, the sealing cap having a sealing cap passageway in fluid communication with the charging unit passageway and the open top of the container;

a sealing cap valve mounted in the sealing cap passageway for controlling the flow of the pressurized gas through the sealing cap passageway into and out from the container; and a first exhaust passageway in the sealing cap in fluid communication between the open top of the container and the atmosphere for venting the trapped gas from the container; a priming valve in the first exhaust passageway for controlling the flow of the trapped gas from the container to the atmosphere via the first exhaust passageway;

second exhaust passageway in the sealing cap in fluid communication between the open top of the container and a vent channel in the charging unit, trigger means in the charging unit connected to a vent channel valve mounted in the vent channel to open the vent channel valve thereby forming the second exhaust passageway for venting the trapped gas from the container to the atmosphere whereby in a first position when the pressurized gas is released from the gas cartridge and enters the charging unit passageway, and the manually operated valve is in the open position for allowing the pressurized gas to flow into the sealing cap, and the sealing cap valve is in the open position, and with the priming valve in the open position, the pressurized gas forces the trapped gas above the liquid to vent to the atmosphere and in a second position with the priming valve in the closed position the pressurized gas fills the container to the predetermined pressure.

10. The device of claim 9 wherein the calibration means comprises a nut on a threaded shaft, the nut engaging a spring for adjusting the force that the spring applies to the valve to cause the valve to close when the predetermined pressure is reached.

11. The device of claim 9 wherein the priming valve is manually operated for selectively opening the priming valve when the pressurized gas flows into the container.

12. The device of claim 9 wherein the sealing cap valve in the sealing cap restrains the flow of pressurized gas from the container through the sealing cap when the charging unit is removed from the sealing cap.

13. A method for pressurizing a container that is at least partially filled with a liquid and a trapped gas comprising;

a. attaching in a fluid tight seal a cartridge containing a pressurized gas to a sealing cap;

b. attaching the sealing cap in a fluid tight seal to an open top of the container;

c. penetrating the cartridge thereby permitting the pressurized gas to flow through a charging passageway, through a sealing cap passageway in the sealing cap and through the open top into the container while simultaneously evacuating the trapped gas from the container through a container evacuation passageway with a priming valve mounted in the container evacuation passageway in the sealing cap;

d. closing the priming valve;

e. continuing the flow of pressurized gas into the container through the charging passageway and sealing cap passageway; and f. stopping the flow of pressurized gas into the container when a predetermined pressure is reached in the container.

14. The method of claim 13 and the further step of forcing the trapped gas from the container by means of the introduction of the pressurized gas from the cartridge and venting the trapped gas through the container evacuation passageway.

15. The method of claim 13 and the further step of relieving excessive pressure in the container if the predetermined pressure is exceeded.

16. The method of claim 13 and the further step of removing the cartridge from the sealing cap and leaving the sealing cap on the container after the predetermined pressure is reached.

17. The method claim 13 and the further step of monitoring the pressure of the pressurized gas in the cartridge and the container.

* * * * *